US012467165B2

(12) United States Patent
Boeck et al.

(10) Patent No.: US 12,467,165 B2
(45) Date of Patent: Nov. 11, 2025

(54) FABRIC TAPE

(71) Applicant: Voith Patent GmbH, Heidenheim (DE)

(72) Inventors: Johann Boeck, Fornach (AT); Jan Gallik, Weyregg (AT)

(73) Assignee: Voith Patent GmbH, Heidenheim (DE)

( * ) Notice: Subject to any disclaimer, the term of this patent is extended or adjusted under 35 U.S.C. 154(b) by 309 days.

(21) Appl. No.: 18/219,835

(22) Filed: Jul. 10, 2023

(65) Prior Publication Data

US 2024/0018700 A1 Jan. 18, 2024

(30) Foreign Application Priority Data

Jul. 12, 2022 (DE) ..... 102022117304.6

(51) Int. Cl.

| | |
|---|---|
| ***D03D 11/00*** | (2006.01) |
| ***D03D 3/00*** | (2006.01) |
| ***D03D 13/00*** | (2006.01) |
| *D03D 1/00* | (2006.01) |

(52) U.S. Cl.

CPC ..... *D03D 11/00* (2013.01); *D03D 3/005* (2013.01); *D03D 13/004* (2013.01)

(58) Field of Classification Search

CPC ..... D21F 1/0036; D21F 7/083; D21F 1/105; D03D 3/04; D03D 11/00; D03D 1/0094; D03D 13/004

See application file for complete search history.

(56) References Cited

U.S. PATENT DOCUMENTS

| | | | | | |
|---|---|---|---|---|---|
| 4,333,502 | A * | 6/1982 | Karm | D21F 1/0036 | 162/903 |
| 4,776,373 | A * | 10/1988 | Borel | D21F 1/0036 | 162/DIG. 4 |
| 4,934,414 | A * | 6/1990 | Borel | D21F 1/0036 | 162/903 |
| 5,152,326 | A * | 10/1992 | Vohringer | D21F 1/0045 | 139/410 |
| 7,025,095 | B2 * | 4/2006 | Zils | D21F 1/0036 | 139/408 |

(Continued)

FOREIGN PATENT DOCUMENTS

| | | | |
|---|---|---|---|
| DE | 102012207044 | A1 | 10/2013 |
| DE | 102013218465 | A1 | 3/2015 |
| EP | 2470716 | B1 | 5/2014 |

*Primary Examiner* — Robert H Muromoto, Jr.

(74) *Attorney, Agent, or Firm* — Von Rohrscheidt Patents

(57) ABSTRACT

A forming fabric tape for a machine for producing or processing a fiber web, the forming fabric tape including an upper fabric layer including upper longitudinal threads and upper transversal threads woven with the upper longitudinal threads; and a lower fabric layer including lower longitudinal threads and lower transversal threads woven with the lower longitudinal threads, wherein the upper fabric layer and the lower fabric layer are arranged above one another so that the upper fabric layer is oriented towards the fiber material web and the lower fabric layer is oriented away from the fiber web, wherein the upper fabric layer is connected with the lower fabric layer by binding threads (B1-B2) running in a transversal direction of the fabric tape, wherein a weaving pattern of the forming fabric tape is repeated in pattern repeats, wherein the pattern repeats are formed from plural longitudinal thread supergroups.

12 Claims, 5 Drawing Sheets

(56) References Cited

U.S. PATENT DOCUMENTS

| | | | | |
|---|---|---|---|---|
| 7,503,351 | B2 * | 3/2009 | Hack-Ueberall | D21F 1/0036 162/348 |
| 7,717,141 | B1 * | 5/2010 | Quigley | D21F 1/0036 139/383 R |
| 9,359,722 | B2 * | 6/2016 | Boeck | D21F 1/105 |
| 9,745,696 | B2 * | 8/2017 | Barrett | D03D 11/00 |
| 11,339,534 | B2 * | 5/2022 | Gleich | D03D 1/00 |
| 12,000,089 | B2 * | 6/2024 | Gleich | D21F 7/10 |
| 12,168,850 | B2 * | 12/2024 | Boeck | D21F 1/0036 |
| 12,276,068 | B2 * | 4/2025 | Boeck | D03D 3/04 |
| 2010/0258259 | A1 * | 10/2010 | Boeck | D21F 1/0045 162/289 |
| 2015/0075743 | A1 * | 3/2015 | Boeck | D21F 1/0036 162/348 |
| 2015/0090417 | A1 * | 4/2015 | Boeck | D21F 1/0045 162/348 |
| 2024/0018700 | A1 * | 1/2024 | Boeck | D21F 1/0036 |

* cited by examiner

FABRIC TAPE

RELATED APPLICATIONS

This application claims priority from and incorporates by reference German Patent Application DE 10 2022 117 304.6 filed on Jul. 12, 2022.

FIELD OF THE INVENTION

The invention relates to a fabric tape, in particular a forming fabric tape for a machine configured to produce and/or process for forming a fiber web.

BACKGROUND OF THE INVENTION

A generic fabric tape is already known from DE 10 2013 218 465 A1. This fabric tape provides satisfactory fiber support through the upper fabric layer and sufficient dimensional stability through the lower fabric layer and is characterized in that the first groups and the second groups in the pattern repeat improve support of the upper longitudinal threads by the lower longitudinal threads compared to known fabric tapes which have already included more lower longitudinal threads than upper longitudinal threads. The improved support of the upper longitudinal threads causes fewer depressions in the upper fabric layer which reduces the propensity for undesirable visible hydraulic markings in the fiber material web.

BRIEF SUMMARY OF THE INVENTION

Though the fabric tape known from the printed document DE 10 2013 218 465 A1 already delivers good results flatness of the upper fabric layer can still be improved in order to further reduce the propensity to cause undesirable visible markings.

The object is achieved by the features of a forming fabric tape for a machine for producing or processing a fiber web, the forming fabric tape including an upper fabric layer including upper longitudinal threads and upper transversal threads woven with the upper longitudinal threads; and a lower fabric layer including lower longitudinal threads and lower transversal threads woven with the lower longitudinal threads, wherein the upper fabric layer and the lower fabric layer are arranged above one another so that the upper fabric layer is oriented towards the fiber material web and the lower fabric layer is oriented away from the fiber web, wherein the upper fabric layer is connected with the lower fabric layer by binding threads running in a transversal direction of the fabric tape, wherein a weaving pattern of the forming fabric tape is repeated in pattern repeats, wherein the pattern repeats are formed from plural longitudinal thread supergroups respectively including the upper longitudinal threads and the lower longitudinal threads, wherein each of the longitudinal thread super groups includes two first groups and a second group, wherein each first group is formed respectively from an upper longitudinal thread and a lower longitudinal thread arranged below the upper longitudinal thread and each second group is formed respectively from an upper longitudinal thread and two lower longitudinal threads arranged below the upper longitudinal thread, wherein each binding thread in the pattern repeat forms at least one multiple binding with the upper transversal threads in the pattern repeat, and wherein the pattern repeat includes at least six longitudinal thread super groups that include the upper longitudinal threads and the lower longitudinal threads.

Advantageous improvements include at least one or more of the following:

The pattern repeat (R) may include exactly six longitudinal threads super groups (WE) including the upper longitudinal threads (O1-O3) and the lower longitudinal threads (U1-U4). The upper fabric layer may be connected with the lower fabric layer in the pattern repeat (R) exclusively by multiple bindings of the binding threads (B1, B2) with the upper longitudinal threads (O1-O3). A first binding thread (B1) in the pattern repeat (R) may form two double bindings with the upper longitudinal threads, and a second binding thread (B2) forms a double binding and a triple binding with the upper longitudinal threads (O1-O3). The binding threads (B1, B2) may be always arranged in binding thread pairs, and the two binding threads (B1, B2) of a respective binding thread pair are woven in an alternating pattern with the upper longitudinal threads (O1-O3) and the lower longitudinal threads (U1-U4) and intersect in intersection points when switching from being woven with the upper longitudinal threads (O1-O3) to being woven with the lower longitudinal threads (U1-U4). The binding threads (B1-B2) form a plain weave of the upper fabric layer with the upper transversal threads (OQF) and the upper longitudinal threads (O1-O3). The lower fabric layer may include a 6-shaft repeat binding of the lower longitudinal threads (U1-U4) or a 8-shaft repeat binding of the lower longitudinal threads (U1-U4) or a 12-shaft repeat binding of the lower longitudinal threads (U1-U4). A lower transversal thread (UQF) may only switch over one or at the most two directly adjacent lower longitudinal threads (U1-U4) and otherwise floats below the remaining lower longitudinal threads (U1-U4) per shaft repeat of the lower longitudinal threads (U1-U4). The upper longitudinal threads (O1-O3) and the lower longitudinal threads (U1-U4) in each group (I, II) need not be offset relative to each other in an orthogonal view of the fabric layers or only slightly offset relative to each other in the orthogonal view of the fabric layers so that a clear space of half a diameter of an upper longitudinal thread (O1-O3) is formed at the most between the upper longitudinal threads and the lower longitudinal threads of each group or there is no free space. A diameter of the lower longitudinal threads (U1-U4) may be greater than a diameter of the upper longitudinal threads (O1-O3). There may be more upper transversal threads (OQF) than lower transversal threads (UQF) or 1.5 times an amount of upper longitudinal threads compared to an amount of lower transversal threads (UQF).

The term "multiple binding" means that a binding thread that transits from the lower fabric layer into the upper fabric layer runs at least over a first upper longitudinal thread, under a second upper longitudinal thread that is directly adjacent to the first upper longitudinal thread and over a third upper longitudinal thread that is directly adjacent to the second upper longitudinal thread before it switches from the upper fabric layer into the lower fabric layer again. Put differently, the binding thread that switches from the lower fabric layer into the upper fabric layer runs over at least two not directly adjacent upper longitudinal threads before it transitions back into the lower fabric layer. However, this can also apply to three or more upper longitudinal threads that are not directly adjacent to one another. When these are exactly two upper longitudinal threads, this is called "double binding" or a "2-binding segment" and when these are exactly three threads is called a "triple binding" or also a "3-binding segment", etc.

The inventors have found that flatness of the upper fabric layer deteriorates when single bindings are used in the pattern repeat exclusively, this means that each binding thread that switches from the lower fabric layer into the upper fabric layer only runs over one upper longitudinal thread before it switches back into the lower fabric layer again. This has the effect that the upper longitudinal thread over which the binding thread is run is pulled down in a relatively sharp turn so that an undesirable depression is formed at this spot in the upper fabric layer. This effect of forming depressions is reduced compared to single binding when using multiple binding.

Additionally, the inventors have found that it is advantageous for low marking properties of a fabric tape when the pattern repeat is made from at least six longitudinal thread super groups which are made in turn from a second group and two first groups like in the instant embodiment. The at least six longitudinal thread super groups which respectively include three upper longitudinal threads and four lower longitudinal threads facilitate to use the binding threads in the fabric as binding thread pairs which continue a plain weave of the upper fabric layer together with the upper longitudinal threads and the upper transversal threads even when each binding thread in the pattern repeat forms at least one multiple binding with the upper transversal threads in the pattern repeat. The plain weave of the upper fabric layer provides good fiber support which advantageously impacts the marking properties of the fabric tape. Theoretically this would also be possible for fewer than six longitudinal thread super groups, namely four longitudinal thread super groups with 12 upper longitudinal threads and 16 lower longitudinal threads. However, it has come as a surprise that fabric tapes of this type have the disadvantage of being relatively thick. This may be caused by the fact that a 16-shaft binding is used for the upper longitudinal threads for the 16 lower longitudinal threads which then causes a rather long floatation of the lower transversal threads, typically to floatation below at least 12 lower longitudinal threads. This, however, means: the longer the floatation the thicker the fabric tape and the thicker the fabric tape the greater the clear volume of the screen and thus the amount of undesirable transported water and required repulsion power etc.

In order not to make the production of the fabric tape according to the invention more complicated than necessary, the upper longitudinal threads and the lower longitudinal threads of the pattern repeat include exactly six longitudinal thread supergroups. The six longitudinal thread super groups have the effect that the pattern repeat includes 18 upper longitudinal threads and 24 lower longitudinal threads, thus in total 42 longitudinal threads. Since the fabric tapes, in particular the forming fabric tapes are typically woven flat, the longitudinal threads correspond to the warp threads, whereas the transversal threads correspond to the weft threads in the weaving process. A pattern repeat with 42 warp threads provides plenty freedom for the design. For example, 3-, 4-, 6-, 8-, or 12-, shaft repeats can be used for the lower fabric layer and 2- or 3-shaft repeats can be used for the upper fabric layer, which already facilitates 10 (=5×2) different designs with respect to the number of shafts of the base binding. The 24 lower longitudinal threads would also facilitate a 24-shaft binding, however this is not advantageous since this leads to very long flotations of the lower longitudinal threads below at least 12 lower longitudinal threads and thus to an undesirable thickness of the fabric tape.

In order to have the least amount of depressions in the upper fabric layer it is advantageous that the upper fabric layer is connected with the lower fabric layer in the pattern repeat exclusively by multiple bindings of the binding threads with the upper longitudinal threads.

In a pattern repeat with six previously described longitudinal thread groups, thus with 18 upper longitudinal threads the upper fabric layer becomes particularly flat when a binding thread pair forms a quadruple binding and the other binding threads of the binding thread pair forms a quintuple binding with the upper longitudinal threads. However, this can cause the undesirable effect that the upper fabric layer and the lower fabric layer are not bonded together with sufficient strength due to the resulting small number of binding points between the upper fabric layer and the lower fabric layer which can lead to an increased inner abrasion of the binding threads at the binding points. In the extreme the two fabric layers can separate from each other. Therefore it is particularly advantageous, in particular when the upper longitudinal threads and the lower longitudinal threads are made exactly from six longitudinal thread super groups and the binding threads configured as binding thread pair continue a plain weave of the upper fabric layer so that a first binding thread of a binding thread pair in the pattern repeat forms two double bindings with the upper longitudinal threads whereas a second binding thread of the binding thread pair forms a double binding and a triple binding with the upper longitudinal threads. This achieves an acceptable flatness of the upper fabric layer and a typically completely sufficient stability of the binding of the upper fabric layer with the lower fabric layer.

As stated supra it is advantageous to always arrange the binding threads in binding thread pairs, wherein the two binding threads of the respective binding thread pair are woven with the upper and lower longitudinal threads in an alternating pattern and intersect in intersection points when alternating between being woven with the upper longitudinal threads in order to be woven with the lower longitudinal threads and vice versa. Thus, the two binding threads of a binding thread pair advantageously correspond to an upper transversal thread in the weaving pattern of the upper fabric layer.

Furthermore, it is advantageous for good fiber material support on the upper fabric layer when the binding threads form a plain weave of the upper fabric layer together with the upper transversal threads and the upper longitudinal threads as stated supra.

Though it is possible to use, for example, 3-shaft or 4-shaft repeat binding for the lower fabric layer, it has proven particularly advantageous in practical applications when the lower fabric layer includes 6-shaft repeat binding or 8-shaft repeat binding or 12-shaft repeat binding with respect to the lower longitudinal threads. In order to provide a maximum wear volume through the lower transversal threads on the machine side of the fabric tape it is advantageous when a lower transversal thread only switches over one or at the most two directly adjacent lower longitudinal threads per shaft repeat and is otherwise floated below the remaining lower longitudinal threads. In particular with 6-shaft repeat binding or 8-shaft repeat binding a lower transversal thread can only be run over one longitudinal thread per shaft repeat, whereas it is also possible for a 12-shaft repeat binding that a lower transversal thread runs over two directly adjacent lower longitudinal threads per shaft repeat.

With respect to flatness of the upper fabric layer it is advantageous when the upper and lower longitudinal threads are not offset at all or only slightly offset relative to each other in each group in an orthogonal view of the fabric layer so that a clear space of a half diameter of an upper longitudinal thread is formed between the upper longitudinal threads and the lower longitudinal threads of a group at the most, advantageously there is no free space at all. Thus, the upper longitudinal threads can be supported by the lower longitudinal threads sufficiently well. Reference is made in this respect to the printed document DE 10 2013 218 465 A1 recited supra.

Advantageously the diameter of the lower longitudinal threads is greater than the diameter of the upper longitudinal threads. The diameter of the lower longitudinal threads can advantageously be in a range of 0.13 mm to 0.35 mm, whereas the upper longitudinal threads have a diameter of 50% to 90% advantageously 60% to 80% of the diameter of the lower longitudinal threads. This provides a fabric tape with a particularly fine upper fabric layer and a lower fabric layer that is sufficiently stable to provide a high wear volume and/or high dimensional stability.

In order to obtain a sufficiently dense upper fabric layer, even when the fabric tape includes fewer upper longitudinal threads than lower longitudinal threads it is advantageous when the fabric tape simultaneously includes a relatively large number of upper transversal threads, in particular more upper transversal threads than lower transversal threads, particularly advantageously 1.5 times or two times the upper transversal threads compared to the lower transversal threads. In this context also binding thread pairs which jointly complete the weave of the upper fabric layer with the upper transversal threads and the upper longitudinal threads, in particular to form a plain weave, shall be counted among the upper transversal threads as well. In this case a binding thread pair would count among the upper longitudinal threads.

BRIEF DESCRIPTION OF THE DRAWINGS

The invention is subsequently described based on advantageous embodiments with reference to drawing figures, wherein.

DETAILED DESCRIPTION OF THE INVENTION

Figure 1:
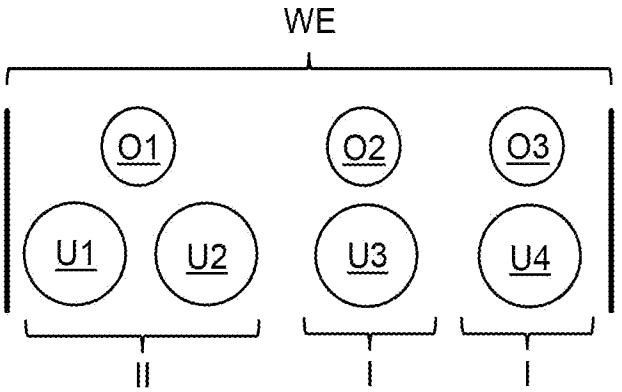
FIG. 1 illustrates a longitudinal thread super group that is used in webbing according to the invention.

FIG. 1 schematically illustrates a detail of the fabric tape according to the invention showing a longitudinal thread super group WE which can also be designated as a repeat unit WE including three upper longitudinal threads O1-O3 and four lower longitudinal threads U1-U4. These longitudinal threads are arranged in three groups, namely two first groups I which are respectively formed by an upper longitudinal thread O2-O3 and a lower longitudinal thread U3-U4 arranged below the upper longitudinal thread and a second group II that is formed by an upper longitudinal thread O1 and two lower longitudinal threads U1-U2 arranged below the upper longitudinal thread. Due to this specific arrangement of the longitudinal threads the upper longitudinal threads O1-O3 can be supported particularly well by the lower longitudinal threads U1-U4 which helps flatness of the upper fabric layer and thus reduces a propensity of the fabric tape to produce hydraulic markings. The upper fabric layer includes the upper longitudinal threads O1-O3 and upper transversal threads and thus transports and/or dries the fiber material web when the fabric tape is being used for producing the fiber material web. This positive effect with respect to the support of the upper longitudinal threads O1-O3 is already described in more detail in the printed document DE 10 2013 218 465A1 recited supra which is incorporated by reference regarding additional details.

The schematic representation of FIG. 1 shows the upper longitudinal threads O1-O3 centered precisely above the lower longitudinal threads U1-U4 of the respective groups. In practical applications, however, there can be some deviation. These deviations are caused by the fact that the longitudinal threads bind with the transversal threads and binding threads which can lead in particular to a movement to the left and to the right relative to the lower longitudinal threads in particular when using thinner upper longitudinal threads. Overall, however, these deviations are typically minor and do not render the individual groups in the fabric unrecognizable.

Figure 2:
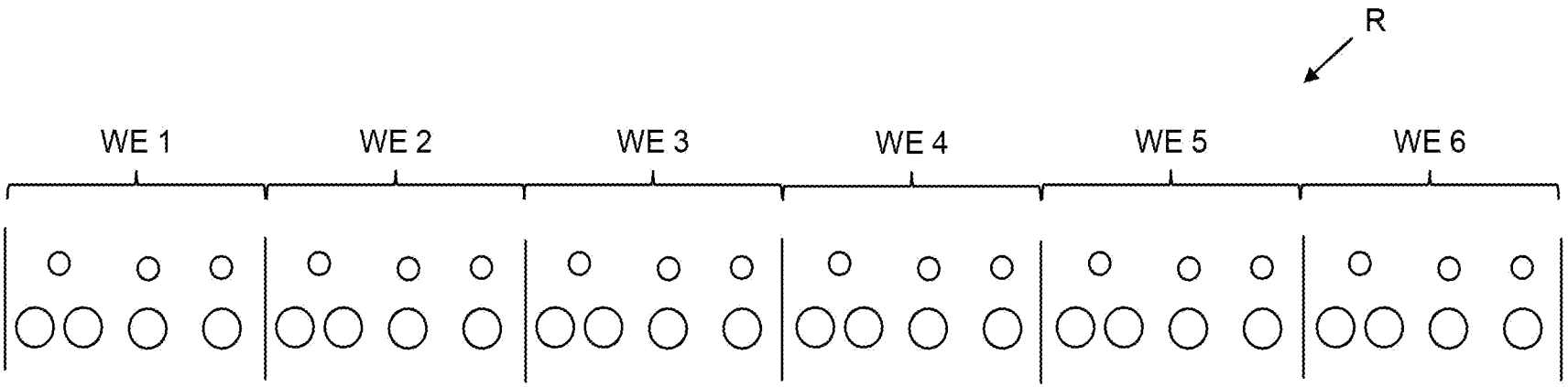
FIG. 2 illustrates the longitudinal threads of a pattern repeat of the webbing according to the invention formed from six longitudinal thread super groups.

The fabric tape includes a weaving pattern that is repeated in pattern repeats R according to the invention. The pattern repeat R is formed from at least six longitudinal threads super groups with respect to the upper longitudinal threads and the lower longitudinal threads of the fabric tape. In particular, the pattern repeat can be formed from precisely six longitudinal thread super groups WE as schematically illustrated in FIG. 2. Thus, the pattern repeat R includes 6×3=18 upper longitudinal threads and 6×4=24 lower longitudinal threads, thus in total 42 longitudinal threads.

Figure 3:
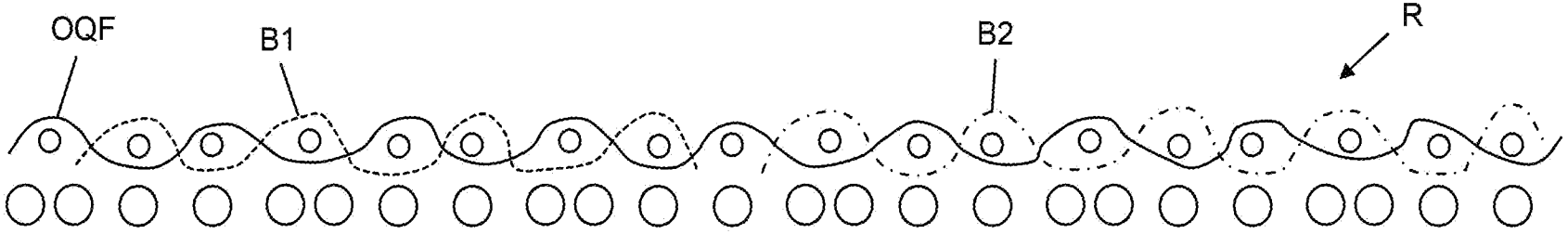
FIG. 3 illustrates a first embodiment of a run of a binding thread pair according to the invention.
Figure 4:
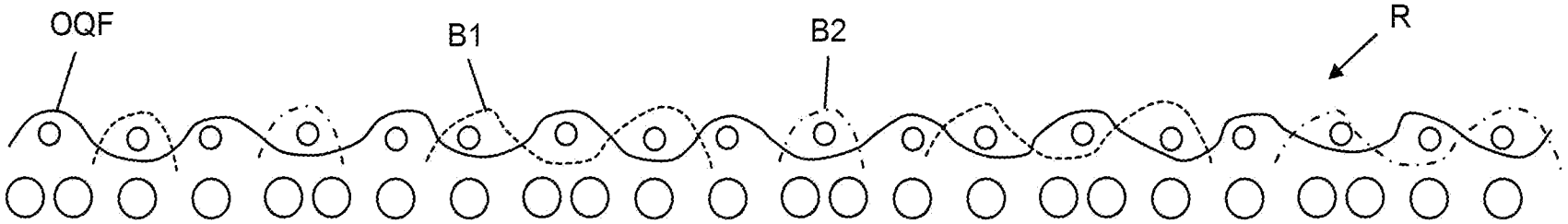
FIG. 4 illustrates a second embodiment of a run of a binding thread pair according to the invention.
Figure 5:
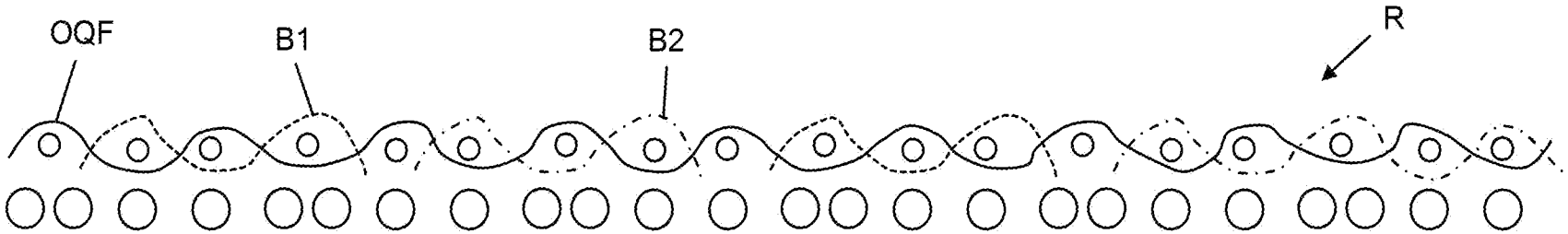
FIG. 5 illustrates a third embodiment of a run of a binding thread pair according to the invention.

Since the pattern repeat R includes at least six, advantageously exactly six longitudinal thread super groups WE, each binding thread B1, B2 according to the invention can form at least one multiple binding with the upper longitudinal threads in the pattern repeat R and the binding threads B1, B2 can continue a plain weave of the upper fabric layer in pairs without rendering the fabric tape too thick. Corresponding embodiments for the path of the binding threads B1-B2 are schematically illustrated in FIGS. 3-5. Thus, the upper longitudinal threads are pulled down less compared to fabric tapes where the binding threads only form single bindings with the upper longitudinal threads so that depressions in the upper fabric layer are prevented or at least reduced. Since the binding threads contribute to the plain weave in the upper fabric layer in pairs, the upper fabric layer can support the fiber material web transported and/or dried thereon particularly well.

FIG. 3 illustrates a first embodiment of the invention with respect to the binding threads B1, B2 showing the upper and lower longitudinal threads of the six longitudinal thread super groups WE in the pattern repeat R like in FIG. 2. Additionally an upper transversal thread OQF from the pattern repeat R is shown which is run in an alternating pattern below and above adjacent upper longitudinal threads in order to form a plain weave in the upper fabric layer. Furthermore, the path of a first binding thread B1 and a second binding thread B2 is shown in sections where the path is part of the upper fabric layer. The two binding threads B1, B2 form a binding thread pair that is directly adjacent to the upper transversal thread OQF wherein the binding thread pair also contributes to the plain weave of the upper fabric layer since each second upper longitudinal thread is bound by one of the two binding threads B1, B2, thus the respective binding thread B1, B2 runs above the upper longitudinal thread, whereas this does not apply to the other upper longitudinal threads arranged there between. In the instant embodiment according to FIG. 3, the dashed first binding thread B1, forms a quadruple binding with the upper longitudinal threads of the pattern repeat R, this means the first binding thread B1 that switches from a bottom left from the lower fabric layer into the upper fabric layer is run overall above four upper longitudinal threads before switching to the bottom right into the lower fabric layer. On the other hand side the dash-dotted second binding thread B2 forms a quintuple binding with the upper longitudinal threads of the pattern repeat R, this means the second binding thread switching from the left from below from the lower fabric layer into the upper fabric layer is run overall over five longitudinal threads before switching to the bottom right into the lower fabric layer again. This embodiment is characterized in that the upper longitudinal thread are hardly pulled down by the binding threads B1, B2 so that excellent flatness of the upper fabric layer can be achieved.

However, this embodiment is not necessarily optimum with regard to strength of the connection of the upper fabric layer with the lower fabric layer through the binding threads B1, B2. This is caused by the fact that this embodiment provides only very few switches of the binding threads B1, B2 from the upper fabric layer into the lower fabric layer in the pattern repeat R.

In order to increase strength of the connection between the two fabric layers it is advantageous to let the binding threads B1, B2 switch in the pattern repeat from the upper fabric layer into the lower fabric layer more often. The second embodiment according to FIG. 4 shows a rather large number of these switches. Subsequently only differences over the first embodiment according to FIG. 3 are addressed and otherwise the description of the first embodiment is being referred to. The same applies accordingly for the additional embodiments. Differently from the first embodiment, the first binding thread B1 and the second binding thread B2 do not only switch from the lower fabric layer into the upper fabric layer once in the pattern repeat R but switch three times respectively. Accordingly, the connection between the two fabric layers is stronger. In return the number of bindings is reduced. Thus, the first binding thread B1 in the pattern repeat R forms a single binding with the second upper longitudinal thread counted from the left and forms a first double binding with the $6^{th}$ and the $8^{th}$ upper longitudinal thread and forms a second double binding with the $12^{th}$ and the $14^{th}$ upper longitudinal thread whereas the second binding thread B2 forms a first single binding with the $4^{th}$ upper longitudinal thread, a second single binding with the $10^{th}$ upper longitudinal thread and a double binding with the $16^{th}$ and $18^{th}$ upper longitudinal thread. In particular, the upper longitudinal threads of the single binding, thus the second, fourth and tenth upper longitudinal thread are pulled down rather strongly by the binding threads B1, B2 since these upper longitudinal threads switch directly before from the lower fabric layer into the upper fabric layer and directly thereafter back again into the lower fabric layer. This is not optimum with respect to flatness of the upper fabric layer.

The embodiment according to FIG. 5 shows a balanced compromise between sufficient strength of the connection of the upper fabric layer at the lower fabric layer on the one hand side and avoiding depressions in the upper fabric layer caused by the single bindings. In this embodiment the two binding threads B1, B2 respectively switch two times per pattern repeat from the lower fabric layer into the upper fabric layer. Thus, single bindings are completely prevented. Therefore, the first binding thread B1 in the pattern repeat R forms a first double binding with the second and fourth upper longitudinal thread and a second double binding with the $10^{th}$ and $12^{th}$ upper longitudinal thread, whereas the second binding thread forms a double binding with the $6^{th}$ and $8^{th}$ upper longitudinal thread and a triple binding with the $14^{th}$, $16^{th}$, and $18^{th}$ upper longitudinal thread.

Figure 6:
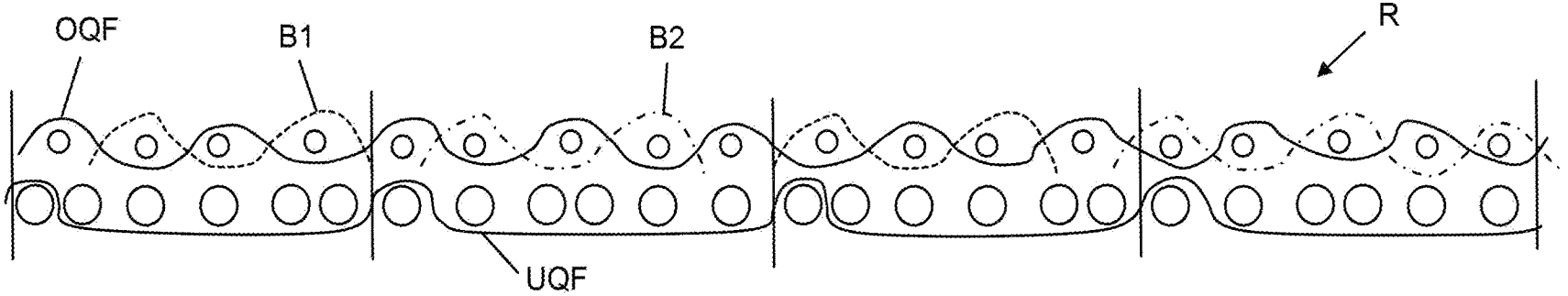
FIG. 6 illustrates a first variant of the third embodiment of the invention according to FIG. 5 including a 6-shaft repeat binding of the lower longitudinal threads.
Figure 7:
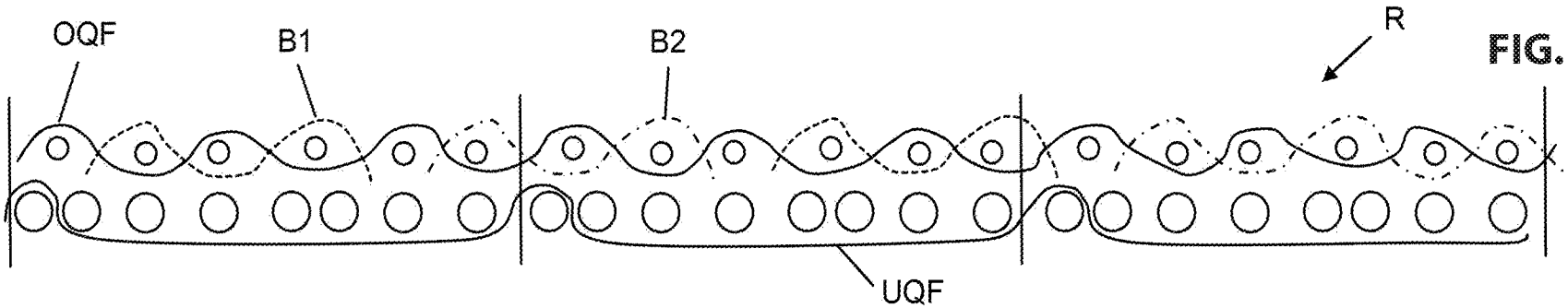
FIG. 7 illustrates a second variant of the third embodiment of the instant invention according to FIG. 5 including an 8-shaft repeat binding of the lower longitudinal threads.
Figure 8:
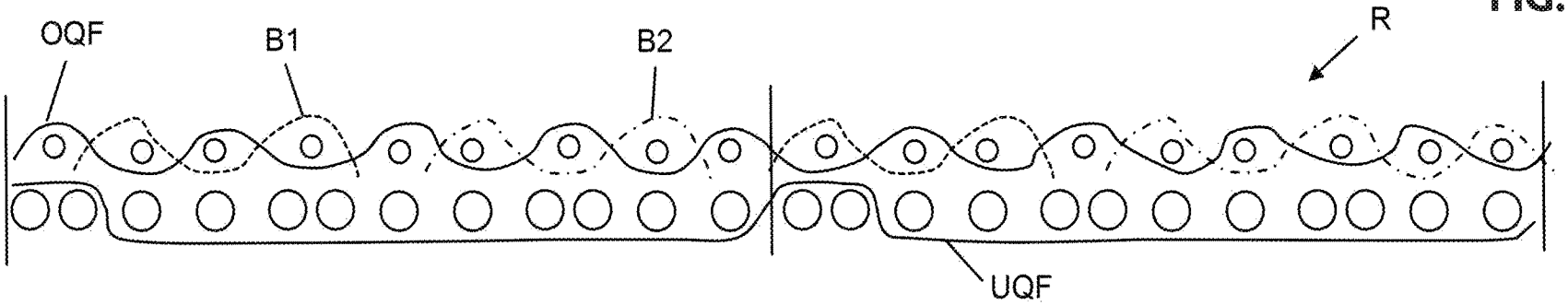
FIG. 8 illustrates a third variant of the third embodiment of the instant invention according to FIG. 5 including a 12-shaft repeat binding of the lower longitudinal threads.

Three different variants of the third embodiment illustrated in FIG. 5 are schematically illustrated in FIGS. 6-8. The three variants different from each other with respect to number of shafts of the lower longitudinal threads. In the first variant according to FIG. 6 the lower fabric layer has a 6 shaft repeat binding with respect to the lower longitudinal threads. Therefore, the weaving pattern of the lower fabric layer that is defined by the lower longitudinal threads and the lower transversal threads is always repeated after six lower longitudinal threads with respect to the respective lower transversal thread UQF. As illustrated in FIG. 6, the lower transversal thread UQF can run over the $7^{th}$, $13^{th}$, and $19^{th}$ lower longitudinal thread in the pattern repeat R and can otherwise float below the remaining lower longitudinal threads. These flotations of the lower transversal thread UQF represent a wear volume for a machine side of the fabric tape oriented away from the fiber material web when the fabric tape is being used.

In the second variant according to FIG. 7, the lower fabric layer has an 8-shaft repeat binding with respect to the lower longitudinal threads. Therefore, the weaving pattern of the lower fabric layer which is defined by the lower longitudinal threads and the lower transversal thread always repeats after 8 lower longitudinal threads with respect to a respective lower transversal thread UQF. As illustrated in FIG. 7, the lower transversal thread UQF can run above the first, ninth, and $17^{th}$ lower longitudinal thread in the pattern repeat R, and can otherwise float under the remaining lower longitudinal threads. These flotations of the lower transversal thread UQF represent a wear volume for the machine side of the fabric tape that is oriented away from the fiber material web when the fabric tape is being used as. Compared to the first variant according to FIG. 6, the flotations are longer in total so that more wear volume can be provided.

In the third variant according to FIG. 8, the lower fabric layer has a 12-shaft repeat binding with respect to the lower longitudinal threads. This has the effect that the weave of the lower fabric layer which is defined by the lower longitudinal threads and the lower transversal threads, repeats after 12 lower longitudinal threads with respect to a lower transversal thread UQF. As illustrated in FIG. 8 the lower transversal thread UQF can run over the first and second and over the 13th and 14th lower longitudinal thread in the pattern repeat R and can otherwise float below the remaining lower longitudinal threads. These flotations of the lower transversal thread UQF represent a wear volume for the machine side of the fabric tape that is oriented away from the fiber material web when operated. Compared to the first variant according to FIG. 6 and the second variant according to FIG. 7, the flotations are longer in total so that more wear volume can be provided.

Figure 9:
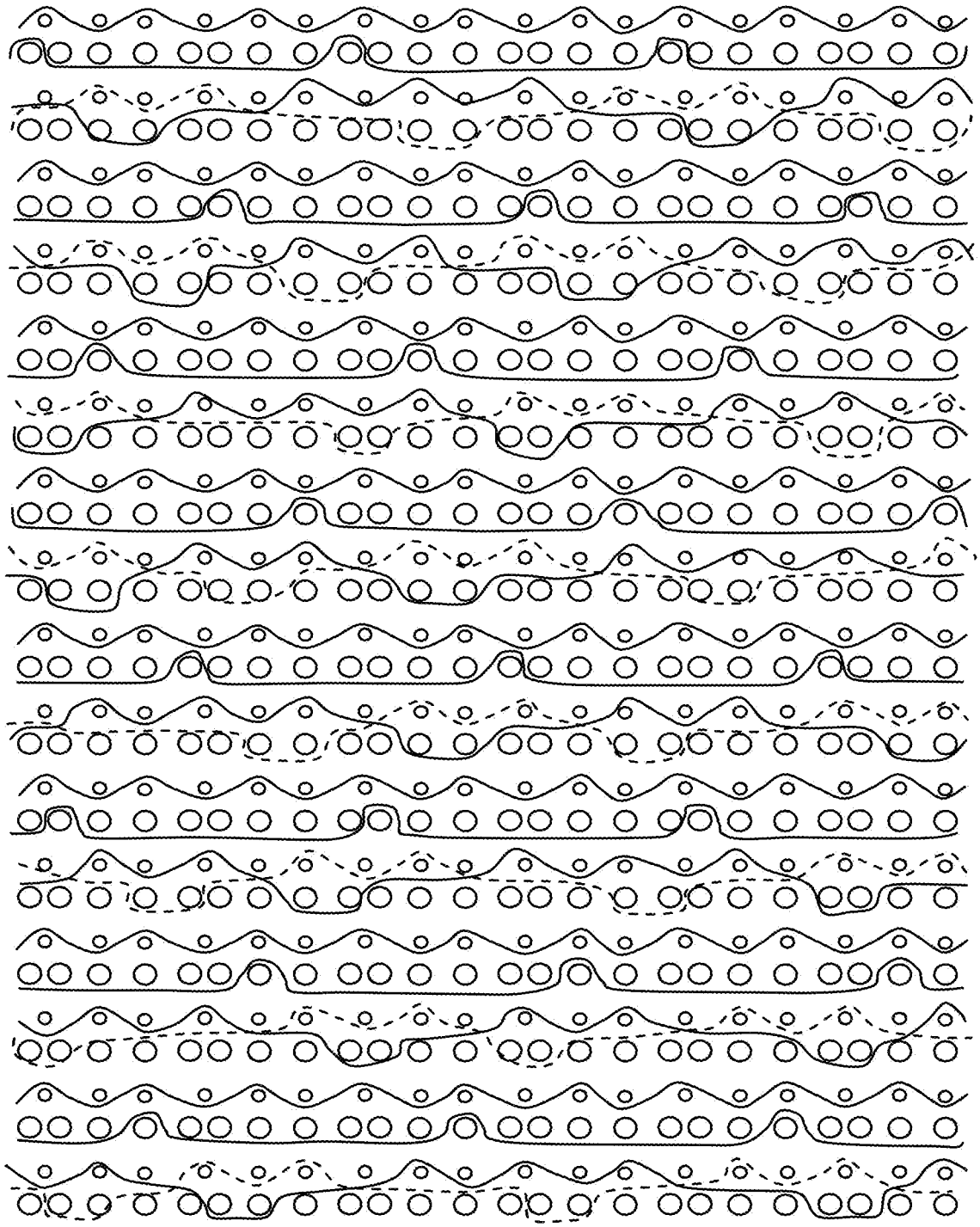
FIG. 9 illustrates a complete pattern repeat of the 8-shaft repeat binding of the lower longitudinal threads according to FIG. 7.

FIG. 9 schematically illustrates the complete weave of a pattern repeat of the second variant illustrated in FIG. 7 having the 8-shaft repeat binding with respect to the lower longitudinal threads showing 8 pairs of a respective upper transversal thread and a lower transversal thread switching above one another and 8 pairs respectively including two binding threads which are shown in dashed lines and how these run above the upper and lower longitudinal threads. Since each pair of two respective binding threads completes the weaving pattern of the upper fabric layer together with the upper transversal threads and the lower longitudinal threads to form a plain weave the respective pair of binding threads can be counted as one upper transversal thread. According to this count, the fabric tape has twice the number of upper transversal threads compared to the lower transversal threads.

Figure 10:
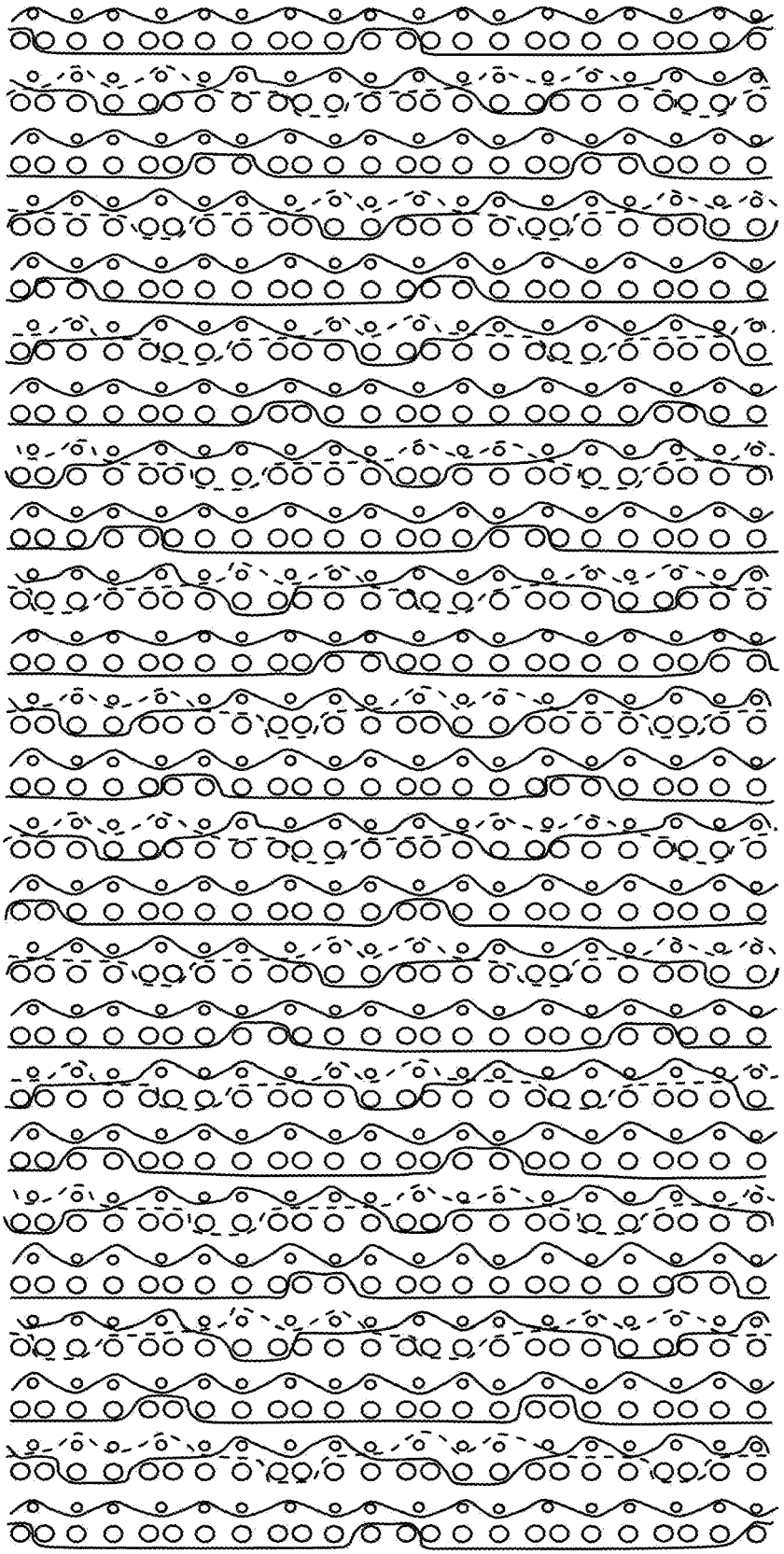
FIG. 10 illustrates a complete pattern repeat of the 12-shaft repeat binding with respect to the lower longitudinal threads according to FIG. 8.

FIG. 10 schematically illustrates the complete weaving pattern of a pattern repeat of the third variant illustrated in FIG. 8 and shows the 12-shaft repeat binding of the upper longitudinal threads, showing the 12 pairs respectively including an upper transversal thread and a lower transversal thread above one another in an alternating pattern and the 12 pairs respectively including 2 binding threads, one of them shown in dashed lines and how these run above an below the upper and lower longitudinal threads.

REFERENCE NUMERALS AND DESIGNATIONS

B1, B2 first binding thread, second binding thread
O1-O3 upper longitudinal threads of longitudinal thread super group
OQF upper transversal thread
R pattern repeat of a weaving pattern of the fabric tape according to the invention
U1-U4 lower longitudinal threads of a longitudinal thread supergroup
UQF lower transversal thread
WE longitudinal thread super group or repeat unit

What is claimed is:

1. A forming fabric tape for a machine for producing or processing a fiber web, the forming fabric tape comprising:
an upper fabric layer including upper longitudinal threads and upper transversal threads woven with the upper longitudinal threads; and
a lower fabric layer including lower longitudinal threads and lower transversal threads woven with the lower longitudinal threads,
wherein the upper fabric layer and the lower fabric layer are arranged above one another so that the upper fabric layer is oriented towards the fiber material web and the lower fabric layer is oriented away from the fiber web,
wherein the upper fabric layer is connected with the lower fabric layer by binding threads running in a transversal direction of the fabric tape, wherein a weaving pattern of the forming fabric tape is repeated in pattern repeats, wherein the pattern repeats are formed from plural longitudinal thread supergroups respectively including the upper longitudinal threads and the lower longitudinal threads,
wherein each of the longitudinal thread super groups includes two first groups and a second group,
wherein each first group is formed respectively from an upper longitudinal thread and a lower longitudinal thread arranged below the upper longitudinal thread and each second group is formed respectively from an upper longitudinal thread and two lower longitudinal threads arranged below the upper longitudinal thread,
wherein each binding thread in the pattern repeat forms at least one multiple binding with the upper transversal threads in the pattern repeat, and
wherein the pattern repeat includes at least six longitudinal thread super groups that include the upper longitudinal threads and the lower longitudinal threads.

2. The forming fabric tape according to claim 1, wherein the pattern repeat includes exactly six longitudinal threads super groups including the upper longitudinal threads and the lower longitudinal threads.

3. The forming fabric tape according to claim 1, wherein the upper fabric layer is connected with the lower fabric layer in the pattern repeat exclusively by multiple bindings of the binding threads with the upper longitudinal threads.

4. The forming fabric tape according to claim 1,
wherein a first binding thread in the pattern repeat forms two double bindings with the upper longitudinal threads, and
wherein a second binding thread forms a double binding and a triple binding with the upper longitudinal threads.

5. The forming fabric tape according to claim 1,
wherein the binding threads are always arranged in binding thread pairs, and
wherein the two binding threads of a respective binding thread pair are woven in an alternating pattern with the upper longitudinal threads and the lower longitudinal threads and intersect in intersection points when switching from being woven with the upper longitudinal threads to being woven with the lower longitudinal threads.

6. The forming fabric tape according to claim 1, wherein the binding threads form a plain weave of the upper fabric layer with the upper transversal threads and the upper longitudinal threads.

7. The forming fabric tape according to claim 1, wherein the lower fabric layer includes a 6-shaft repeat binding of the lower longitudinal threads or a 8-shaft repeat binding of the lower longitudinal threads or a 12-shaft repeat binding of the lower longitudinal threads.

8. The forming fabric tape according to claim 7, wherein a lower transversal thread only switches over one or at the most two directly adjacent lower longitudinal threads and otherwise floats below the remaining lower longitudinal threads per shaft repeat of the lower longitudinal threads.

9. The forming fabric tape according to claim 1,
wherein the upper longitudinal threads and the lower longitudinal threads in each group are not offset relative to each other in an orthogonal view of the fabric layers or only slightly offset relative to each other in the orthogonal view of the fabric layers so that a clear space of half a diameter of an upper longitudinal thread is formed at the most between the upper longitudinal threads and the lower longitudinal threads of each group or there is no free space.

10. The forming fabric tape according to claim 1, wherein a diameter of the lower longitudinal threads is greater than a diameter of the upper longitudinal threads.

11. The forming fabric tape according to claim 1, further comprising: more upper transversal threads than lower transversal threads.

12. The forming fabric tape according to claim 11, further comprising: 1.5 times an amount of upper transversal threads compared to an amount of lower transversal threads.

* * * * *